US005996775A

United States Patent [19]

Hendrickx

[11] Patent Number: 5,996,775

[45] Date of Patent: Dec. 7, 1999

[54] TRANSPORT ELEMENT FOR FLAT GOODS

[75] Inventor: Arthur F. L. Hendrickx, Luyksgestel, Netherlands

[73] Assignee: Ten Cate Enbi B.V., Nuth, Netherlands

[21] Appl. No.: 08/754,631

[22] Filed: Nov. 21, 1996

[30] Foreign Application Priority Data

Nov. 22, 1995 [DE] Germany ..... 195 43 516

[51] Int. Cl.[6] ..... B65G 39/10; B25F 5/02; F16C 13/00

[52] U.S. Cl. ..... 198/780; 198/722; 198/843; 492/45; 492/56; 492/28; 492/20; 492/30

[58] Field of Search ..... 198/722, 723, 198/780, 843; 492/45, 20, 30, 28, 56; 474/902

[56] References Cited

U.S. PATENT DOCUMENTS

| | | | |
|---|---|---|---|
| 696,416 | 4/1902 | Denegre | 492/45 |
| 1,569,343 | 1/1926 | Voegeli | 492/45 |
| 1,833,461 | 6/1931 | Grupe | 492/28 |
| 1,883,184 | 7/1932 | Weber | 492/30 |
| 2,066,755 | 1/1937 | Wilkie | 492/45 |
| 2,639,560 | 5/1953 | Cosmos | 492/45 |
| 2,715,879 | 8/1955 | Sawyer | 492/45 |
| 2,770,868 | 7/1956 | Streckfus et al. | 492/45 |
| 2,773,300 | 3/1956 | Clements | 492/56 |
| 3,184,828 | 5/1965 | Dames, Jr. | 492/45 |
| 5,468,531 | 11/1995 | Kikukawa et al. | 492/56 |

FOREIGN PATENT DOCUMENTS

| | | | |
|---|---|---|---|
| 1113798 | 4/1956 | France | 492/56 |
| 463484 | 3/1975 | U.S.S.R. | 492/30 |

*Primary Examiner*—Karen M. Young
*Assistant Examiner*—Thuy V. Tran
*Attorney, Agent, or Firm*—W. F. Fasse; W. G. Fasse

[57] ABSTRACT

A transport element (1) for transporting or conveying flat goods, such as sheet goods like paper in photocopy machines and printers, includes an inner support member (2) that can be connected to an axle or shaft, and an outer ring member (14) of a rubber-elastic material that at least partially surrounds and is connected in a form-locking manner to the support member (2). The rubber-elastic material has a greater elasticity than the material of the support member (2). The ring member (4) has an outer contact surface (5) for frictionally gripping and transporting the flat goods. The support member (2) has a plurality of grooves (7) distributed around an outer circumferential surface (6) thereof. The rubber-elastic material of the ring member (4) form-lockingly engages the grooves (7). The grooves (7) are open at least toward the outer circumferential surface (6) with a respective opening width (16) that spans an angle α of at most 5°, and are undercut radially inwardly below the openings. As a result, the transport element (1) exhibits only very small fluctuations in the radially measured effective elasticity or spring constant thereof as evaluated around the circumference of the contact surface (5).

20 Claims, 2 Drawing Sheets

TRANSPORT ELEMENT FOR FLAT GOODS

FIELD OF THE INVENTION

The invention relates to a transport element for flat goods, such as sheet goods like paper, cardboard and film goods. The transport element includes an inner support member that can be connected to an axle or shaft, or that is at least provided with an axle or shaft stub, and an outer ring member that at least partially surrounds and encloses the support member and is connected thereto in a form-locking manner. The ring member is made of a rubber-elastic material having an elasticity greater than the elasticity of the material of the support member. The ring member has an outer contact surface for frictionally gripping and transporting the flat goods.

BACKGROUND INFORMATION

Transport elements in the above described general field are frequently used in photocopy machines, printers, or other office machines for transporting paper, cardboard, film or similar sheet goods. In this context, it is known to use embodiments of the transport element having a circular support member and a circular ring member, as well as embodiments having a circular segment-shaped support member and a similarly circular segment-shaped ring member fittingly arranged thereon, e.g. so-called D-rollers.

In a generally known embodiment of such a transport element, the support member comprises a hub for receiving an axle or a shaft, and has an outer circumferential surface provided with nubs or protrusions that project radially outwardly and that are arranged uniformly distributed around the circumference of the outer circumferential surface. These nubs have a pyramidal frustum shape, with an increasing cross-sectional area as the radial distance from the hub increases. In a manner of speaking, the pyramidal frusta are standing on their heads, i.e. are arranged with their narrower ends facing radially inwardly. Thus, each pyramidal frustum-shaped nub is connected by only a relatively small surface to the outer circumferential surface of the support member.

During the manufacturing of the known transport element, the support member is first produced from a thermosetting or a thermoplastic synthetic material by an injection molding process. Next, the support member is inserted into another injection molding tool, in which the ring member is formed by injection molding a rubber-elastic material around the support member. When the material for the ring member is in a molten flowable condition, it can completely flow around and enclose the nubs on the surface of the support member.

After the material of the ring member cures, a form-locking connection results between the support member and the ring member, due to the form of the individual nubs having cross-sections tapering radially inwardly toward the outer circumferential surface of the support member. This interconnection achieves a rotational rigidity of the ring member relative to the support member and also secures the ring member against a radially directed pulling-off thereof. Furthermore, an axial shifting of the ring member relative to the support member is prevented, since the pyramidal frustum-shaped nubs have a smaller axial extension in comparison to the axial width of the support member, both in the area of the base and also in the area of the frustum peak of the nubs.

It has become apparent as a very great disadvantage in the known transport elements, that the effective elasticity of the transport element measured in a radial direction comprises large fluctuations when evaluated around the circumferential direction along the contact surface of the ring member. In other words, different locations on the contact surface around the circumference thereof will exhibit greatly differing radially directed elasticities. These fluctuations in the elasticity result from relatively large variations or differences in the effective thickness of the ring member made of the rubber-elastic material, whereby this effective thickness is a decisive factor determining the elastic behavior of the transport element. Namely, the ring member is considerably thicker in the area between the respective nubs than in the area of the base of each respective upside-down pyramidal frustum-shaped nub. Since the elasticity of the rubber material of the ring member is generally considerably greater than the elasticity of the material of the support member and particularly the nubs thereof, the thickness of the ring member is predominantly significant for establishing the effective radial spring stiffness or spring constant of such a rollingly supported transport element.

As a result of the above described fluctuations of the effective spring constant or elasticity of the known transport element, such a transport element has unsatisfactory characteristics with regard to an exact conveying or transporting behavior. In other words, the known transport element does not satisfactorily and uniformly achieve an accurate and precise transport of the flat goods being conveyed. The requirements as to the exact positioning of the sheets or films being conveyed by such transport elements have constantly increased in the past and are also expected to continue to increase in the future. Therefore, conventional transport elements can no longer meet these requirements.

Attempts to reduce the differences in the angle-dependent effective spring constants by increasing the thickness of the ring member around the entire circumference, while maintaining the same geometry of the support member, have resulted in two disadvantages. First, the axial flexural stiffness of the transport element is reduced, especially in the area of the contact surface. Secondly, the cost of the transport element is increased due to an increased consumption of the comparatively expensive rubber-elastic material of the ring member.

OBJECTS OF THE INVENTION

In view of the above it is the aim of the invention to achieve the following objects singly or in combination:

- to provide a rotatably supportable transport element for transporting or conveying flat goods, that has a substantially uniform and constant radially directed elasticity of a rubber elastic ring member of the transport element, i.e. that the radially directed elasticity has at most only small fluctuations when evaluated around the circumferential direction along the contact surface of the ring member;
- to provide such a transport element with a sufficiently rigid and secure connection between the support member and the ring member, to at least substantially prevent rotational and axial slipping or shifting relatively between the ring member and the support member;
- to provide such a transport element that is economical to produce;
- to provide such a transport element that achieves a substantially uniform frictional gripping and conveying characteristic on a flat sheet good that is being transported, for all angular positions of the transport element, and thereby achieves an improved accuracy and precision of positioning and conveying the flat sheet good;

to construct such a transport element to reduce or avoid the possibility of breakage of interconnection profiles between the ring member and the support member due to inadequate cross-sectional areas of such interconnection profiles; and to provide such a transport element with means for altering the material density and therewith the material elasticity of the rubber-elastic material of the ring member in areas that would otherwise tend to exhibit an undesirable fluctuation of the elasticity.

SUMMARY OF THE INVENTION

The above objects have been achieved according to the invention in a transport element of the above described general type having an inner support member such as a wheel hub member adapted to be rotationally driven about a rotational axis, and an outer friction member such as a ring member arranged on the support member in a form-locking manner to at least partially enclose and surround the support member, wherein the ring member is made of a rubbery-elastic material with an elasticity greater than that of the material of the support member. According to the invention, the support member has an outer circumferential surface with a plurality of grooves arranged distributed therein. Each groove is open at least toward the outer circumferential surface, is respectively undercut or back-tapered in relation to the respective radial direction, and has an opening width that spans or extends over an angle of at most 5° about the rotational axis.

Due to the very small opening width of the grooves, the support member has a circumferential contour that can be described in the first order as a circle or a circular segment or sector. Only when it is described in the second order does the outer circumferential surface of the support member comprise narrow grooves. These grooves are provided so that the rubber-elastic material of the ring member can penetrate into the grooves during the surrounding injection molding of the support member, and can then cure therein so as to embody the above mentioned form-locking connection.

As a result of the narrow opening width of the grooves, the rubber-elastic material of the ring member located within the grooves hardly has any effect on the radially measured effective spring constant of the transport element, due to the very effective adhesion of the rubber-elastic material onto the intrados or curved walls of the groove, especially in the narrowed throat area of the opening of each groove. Thus, when a radial compression loading is applied to a rotatably supported transport element according to the invention, the rubbery-elastic material of the ring member becomes compressed due to the build-up of the compressive stress in the area of the narrow opening cross-section of the groove since the rubbery-elastic material cannot slide away along the intrados or curved walls of the grooves sufficiently to relieve the stress. In turn, this material compression results in an increase in the spring constant or stiffness of the material.

In view of the above, the invention achieves the following effect. Under a condition of radial compression loading, a groove with the small opening width according to the invention causes a localized hardening of the material precisely at the groove location, where the material would otherwise be expected to be softer or more elastic due to the depth of the groove and the corresponding increase in the local thickness of the ring member. Thus, the invention compensates for the expected softening or increase of elasticity at the locations of the grooves. As a result, the effective elasticity or spring constant of the transport element in the area of the groove openings is approximately the same as the spring constant in the area of the webs located between respective adjacent grooves.

Therefore, the resulting fluctuations in the effective elasticity of the transport elements around the circumference thereof are very small in comparison to those of elements according to the state of the art. Accordingly, the transport element of the invention has transport characteristics that are very advantageous because they are not subject to any appreciable fluctuations, and that are of decisive significance, for example, for an exact paper feed advance in printers or photocopying machines.

Through various experiments it has been determined that an optimal balance between achieving a uniform elasticity on the one hand, and avoiding an increasing production effort and expense that arises for further reduction in the size of the opening width on the other hand, is achieved when the opening width spans or extends over an angle in the range of 2° to 3°.

In one embodiment of the transport element, the surfaces of webs respectively located between each two neighboring grooves in the outer circumferential surface of the support member extend over an angle of at most 20°. In this manner, even for small transport elements, a sufficient number of grooves is still provided so that a sufficient form-locking connection between the support member and the ring member is achieved. If the web surfaces respectively span or extend over an angle in the range of 5° to 10°, then a very large number of grooves will result, without the respective thinnest portion of each web located between two adjacent grooves becoming too narrow in larger transport elements, even when the grooves are provided with a sufficient undercut.

Production advantages for the transport element can be achieved if the grooves are open to at least one end face of the support member. If the ring member and the support member are arranged to terminate axially flush with one another on at least one end face in the area of their common joint interface surface, then the transport element according to the invention will exhibit a constant radially measured spring stiffness across the axial width of the transport element all the way to the edge or rim at the end face having the flush termination.

According to another embodiment of the transport element of the invention, insofar as the ring member encloses the support member on at least one end face, an undesired axial shifting of the ring member in relation to the support member is prevented in at least one direction.

A further advantageous detail of the transport element according to the invention is that the cross-section of each groove respectively includes an essentially rectangular or square-sided throat portion and adjoining thereto a circular clamping portion. The diameter of the clamping portion is substantially larger than the opening width of the throat portion. Such an embodiment is characterized by a high clamping force applied to the material of the ring member enclosed within the grooves, due to the pronounced undercutting or back tapering of the grooves. This embodiment can be manufactured with a small production effort and expense, due to the geometrically simple form.

If the webs arranged between two neighboring grooves have a minimum wall thickness corresponding to at least the opening width of the grooves, then the danger of breakage of one of the webs is extremely small, even when the support member is handled and stored without great care after it is produced by injection molding techniques and before it is surrounded or jacketed with the ring member.

According to a further embodiment of the invention, the grooves are respectively divided into two sections with regard to their length, by a respective center web. In this embodiment, a very great security against axial shifting of the ring member and the support member relative to each other can be achieved even when the ring member and the support member terminate axially flush with one another on both end faces of the transport element. In this connection, it is preferred for simplicity of production, that the central webs respectively extend at least over the entire cross-section of the associated groove.

For production reasons, it is also especially simple to achieve a further embodiment of the transport element, wherein the central webs are interconnected with one another by means of an encircling band that protrudes radially outwardly above the outer circumferential surface of the support member and that is connected with the webs. Such an encircling band preferably is located directly at the parting plane of an associated injection molding tool used for producing the transport element. The thickness of the encircling band advantageously corresponds to the thickness of the central webs.

BRIEF DESCRIPTION OF THE DRAWINGS

In order that the invention may be clearly understood, it will now be described, by way of example embodiments, with reference to the accompanying drawings, wherein.

DETAILED DESCRIPTION OF PREFERRED EXAMPLE EMBODIMENTS AND OF THE BEST MODE OF THE INVENTION

Figure 1:
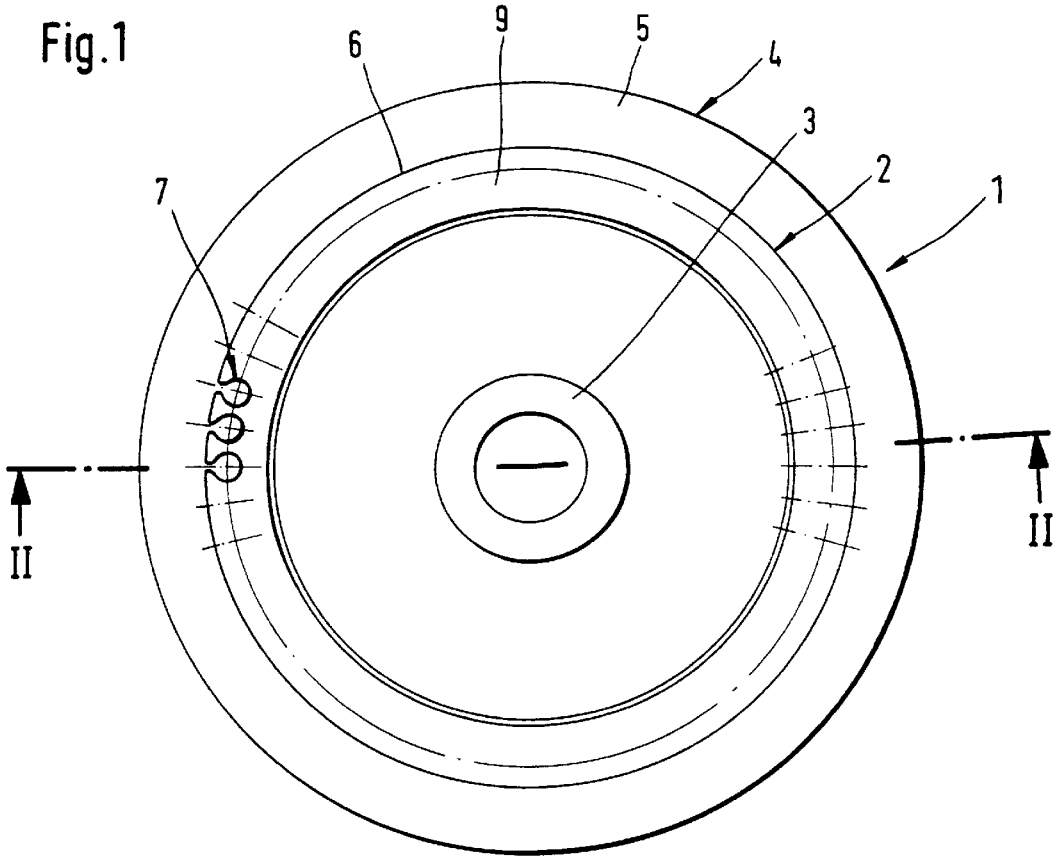
FIG. 1 is an end view of a transport element according to the invention having a circular contour.
Figure 2:
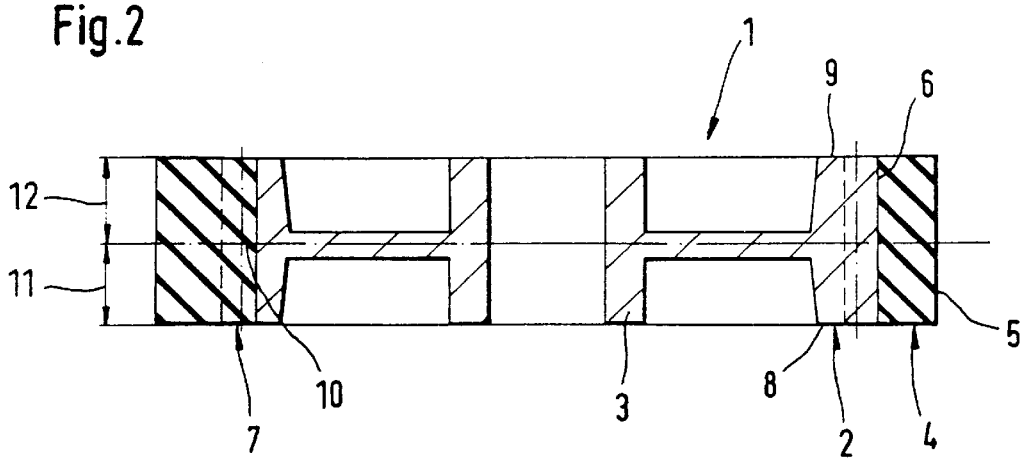
FIG. 2 is a lengthwise section through the transport element according to FIG. 1 along the section line II—II shown in FIG. 1.

FIGS. 1 and 2 show a transport element 1 for conveying or transporting flat goods, for example sheet goods such as paper or film. The transport element 1 comprises an inner support member 2 generally in the form of a hub wheel, which includes a hub 3 for receiving an axle or shaft that is not shown. The transport element 1 further comprises an outer ring member 4 as a friction member which completely surrounds and encircles the support member 2 and is connected therewith in a form-locking manner. In the present embodiment, both the support member 2 and the ring member 4 have a full circle contour.

The support member 2 is produced from a synthetic material by an injection molding process, but may alternatively be produced of metal, for example aluminum or a zinc alloy. The support member 2 comprises an outer circumferential surface 6 having a plurality of grooves 7 arranged equidistantly distributed therein. For reasons of simplicity, only three of the grooves 7 are shown in FIG. 1. As can be seen in FIGS. 1 and 2, the grooves 7 are open to both end faces 8 and 9 of the support member 2. The grooves 7 are respectively divided, in relation to their length, into two respective sections 11 and 12 having equal lengths, by a center web 10. The center webs 10 are also formed during the injection molding production of the support member 2, wherein the center webs 10 are connected throughout or continuously with the associated intrados or curved walls as well as the floor of the grooves 7, and respectively extend over the entire cross-section of the grooves 7.

The ring member 4 essentially consists of a rubber-elastic material, having an elasticity that is substantially greater than the elasticity of the material of the support member 2. The ring member 4 is preferably formed onto the support member 2 after the support member 2 has been formed, e.g. by injection molding, as follows. The finished support member 2 is inserted into a further injection molding tool and is therein surround-molded with the rubber-elastic material by a further injection molding process, whereby the ring member 4 is formed. In this manner, the rubber-elastic material of the ring member 4 extends into and engages the grooves 7 in the support member, thereby form-locking the two parts together. The finished ring member 4 comprises an encircling circumferential contact surface 5 for frictionally gripping and transporting the flat goods. Moreover, it can be seen in the above mentioned figures, that the support member 2 and the ring member 4 terminate flush with one another on at least one and preferably both end faces 8 and 9 of the support member 2.

Figure 3:
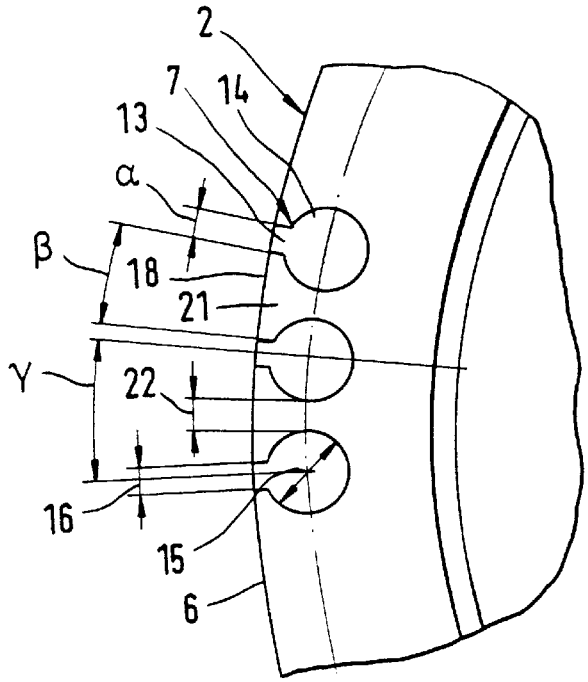
FIG. 3 is an enlarged detail view of a portion of the support member of the transport element shown in FIG. 1, wherein the ring member has been omitted for clarity.

FIG. 3 shows an enlarged portion of the end view of the support member 2 of the transport element 1 shown in FIG. 1, specifically in the area of the three illustrated grooves 7. As can be seen in FIG. 3, the cross-section of each groove 7 respectively comprises an essentially rectangular or square-sided throat portion 13 and adjoining thereto a circular clamping portion 14. The diameter 15 of the clamping portion 14 is approximately three times the opening width 16 of the throat portion 13 in the illustrated preferred embodiment, but may have other relative dimensions, namely at least twice or for example about four times the opening width 16.

The opening width 16 of the groove 7 spans or extends over an angle $\alpha$ a of approximately 2° in this embodiment. The web surfaces 18 of the webs 21, which are respectively located between two respective neighboring grooves 7 in the outer circumferential surface 6 of the support member 2, respectively span or extend over an angle $\beta$ of approximately 5°. As a result, the two mid-lines of neighboring grooves 7 enclose an angle $\gamma$ of approximately 7°. Furthermore, the webs 21 respectively arranged between two neighboring grooves 7 have a minimum wall thickness 22 that amounts to approximately 1.2 times the opening width 16 of the grooves 7 in this embodiment, but which generally is at least as large as the opening width 16.

Figure 4:
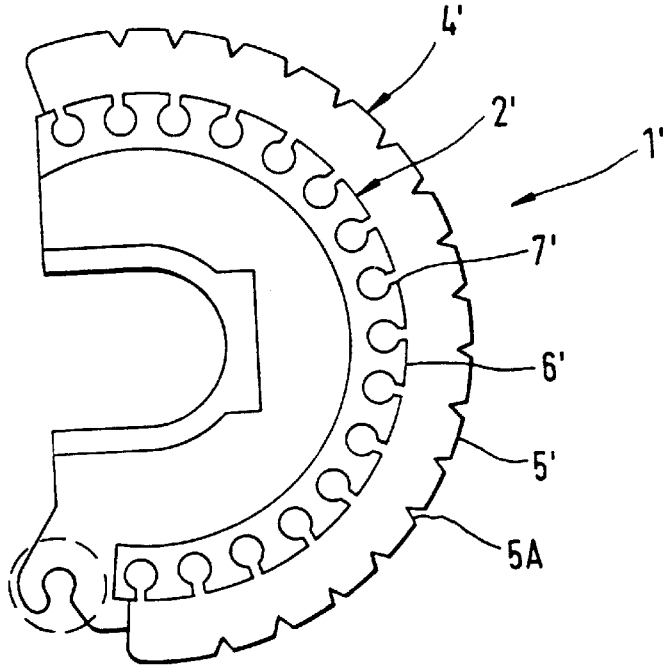
FIG. 4 is an end view of a transport element according to the invention having a D-shaped contour.

FIG. 4 shows an end view of a modified transport element 1', wherein both the support member 2' and also the ring member 4' comprise a D-shaped outer contour. For this reason, such a transport element 1' is also commonly known as a D-roller. The structure of the support member 2' with a plurality of grooves 7' arranged distributed around an outer circumferential surface 6' thereof is generally analogous to the structure of the support member 2 shown and described with reference to FIGS. 1 to 3. The structure of the ring member 4' is also generally analogous to that of the ring member 4 described above. Furthermore, as shown in FIG. 4, the ring member 4' or 4 may have notches or grooves, such as V-shaped grooves 5A, on its outer circumferential contact surface 5' in order to affect the grip characteristics of the transport element 1 or 1' on the flat goods to be conveyed.

Although the invention has been described with reference to specific example embodiments, it will be appreciated that it is intended to cover all modifications and equivalents within the scope of the appended claims.

what is claimed is:

1. A transport element for transporting flat goods, comprising:

an inner support member adapted to be rotationally driven about a rotational axis and comprising a first material having a first elasticity; and an outer friction member comprising a rubbery-elastic material having a second elasticity that is greater than said first elasticity;

wherein said support member has an outer at least partial circumferential surface with a plurality of grooves arranged distributed therein, said grooves respectively have openings that open toward said outer circumferential surface and are respectively undercut radially inwardly below said openings, and said openings respectively have opening widths that each span a first angle ($\alpha$) about said rotational axis of at most 5°; and wherein said friction member is arranged on said outer circumferential surface at least partially surrounding said support member and reaching into said grooves to connect said friction member with said support member in a form-locking manner, and said friction member has an outer contact surface adapted to frictionally grip and transport the flat goods.

2. The transport element of claim 1, wherein said first angle ($\alpha$) is in a range from 2° to 3°.

3. The transport element of claim 1, wherein said support member comprises a plurality of webs respectively extending substantially radially outwardly between respective neighboring ones of said grooves, each of said webs has an outer web surface forming a portion of said outer circumferential surface, and each said outer web surface spans a second angle ($\beta$) about said rotational axis of at most 20°.

4. The transport element of claim 3, wherein said second angle ($\beta$) is in a range from 5° to 10°.

5. The transport element of claim 1, wherein said support member has two end faces substantially perpendicular to said rotational axis, and said grooves respectively have open ends at least at one of said end faces.

6. The transport element of claim 1, wherein said grooves respectively have open ends at both of said end faces.

7. The transport element of claim 1, wherein said support member has two end faces substantially perpendicular to said rotational axis, and said support member and said friction member have a joint interface therebetween and terminate flush with each other at an area of said joint interface at least at one of said end faces.

8. The transport element of claim 1, wherein said support member has two end faces substantially perpendicular to said rotational axis, and said friction member overlaps and at least partially covers at least one of said end faces of said support member.

9. The transport element of claim 1, wherein each of said grooves has a cross-sectional shape including a substantially rectangular throat portion forming said opening and, extending therefrom, a substantially circular clamping portion forming said undercut, wherein said clamping portion has a diameter that is substantially greater than said opening width of said throat portion.

10. The transport element of claim 9, wherein said diameter is at least two times said opening width.

11. The transport element of claim 9, wherein said diameter is about three times said opening width.

12. The transport element of claim 1, wherein said support member comprises a plurality of webs respectively extending substantially radially outwardly between respective neighboring ones of said grooves, and each one of said webs has a minimum wall thickness that is at least as large as said opening widths of said openings of said grooves.

13. The transport element of claim 1, further comprising a respective center web arranged in each one of said grooves, dividing a length thereof into two respective groove sections.

14. The transport element of claim 13, wherein each said center web extends at least entirely across a cross-section of said groove in which said center web is arranged.

15. The transport element of claim 13, further comprising an encircling band arranged projecting radially outwardly from said outer circumferential surface of said support member, wherein said center webs are respectively connected to said encircling band and are thereby interconnected together, and wherein said encircling band has a thickness that corresponds to a thickness of said center webs.

16. The transport element of claim 1, wherein said support member and said friction member each have a full circle shape.

17. The transport element of claim 1, wherein said support member and said friction member each have a circular segment or circular sector shape.

18. The transport element of claim 1, wherein said outer contact surface of said friction member has grooves therein.

19. The transport element of claim 1, wherein said transport element has an effective elasticity measured radially at said outer contact surface, and wherein said effective elasticity is substantially uniform over a circumferential direction of said outer contact surface.

20. The transport element of claim 1, wherein said grooves extend substantially parallel to said rotational axis and are distributed with a uniform radial interspacing therebetween over a circumferential direction of said outer circumferential surface.

* * * * *

UNITED STATES PATENT AND TRADEMARK OFFICE

CERTIFICATE OF CORRECTION

PATENT : 5,996,775

DATED : December 7, 1999

INVENTOR(S) : Arthur F. L. Hendrickx

It is certified that error appears in the above-identified patent and that said Letters Patent is hereby corrected as shown below:

On the title page, under item [56], line 7, replace "6/1931" by –11/1931–;
line 4, replace "7/1932" by –10/1932–;
line 8, replace "7/1956" by –11/1956–;
line 9, replace "3/1956" by –12/1956–.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*